United States Patent [19]

Elliott

[11] Patent Number: 4,473,025

[45] Date of Patent: Sep. 25, 1984

[54] CONTROL CIRCUIT

[76] Inventor: David H. Elliott, R.R. 3, Box 425, Syracuse, Ind. 46567

[21] Appl. No.: 406,259

[22] Filed: Aug. 9, 1982

[51] Int. Cl.[3] ..... B63J 2/06

[52] U.S. Cl. ..... 114/211; 98/1; 123/179 B; 307/9; 307/141.4; 361/111

[58] Field of Search ..... 114/211; 98/1; 123/179 B, 179 BG; 307/9, 141, 141.4; 361/111

[56] References Cited

U.S. PATENT DOCUMENTS 3,684,895 8/1972 Edelson ..... 307/141 X 3,948,202 4/1976 Yoshikawa ..... 114/211

4,068,279 1/1978 Byrnes ..... 361/111 X

*Primary Examiner*—Sherman D. Basinger

*Attorney, Agent, or Firm*—Roger M. Rickert

[57] ABSTRACT

A starter control circuit is disclosed having particular utility in boats with inboard or inboard/outboard engines. The starter control circuit is coupled to the ignition switch and actuates a ventilation circuit prior to actuation of the starting circuit so that the engine compartment of the boat can be ventilated of any combustible fumes which may have accumulated therein prior to engine ignition.

20 Claims, 2 Drawing Figures

CONTROL CIRCUIT

BACKGROUND OF THE INVENTION

The present invention relates to starter control circuits, and more particularly to starter control circuits for internal combustion engines.

A potential hazard of explosion exists whenever an engine is started in the presence of a combustible atmosphere such as gasoline or diesel oil. This problem particularly exists in boats having inboard or inboard/outboard engines wherein fuel fumes can accumulate in the engine compartment and create an explosive environment which can be ignited by the actuation of the boat's electric starting circuit. Accordingly, recommended procedures for starting this type of boat include first inspecting the engine compartment to determine if any such fumes may be present, or alternatively, completely ventilating the engine compartment prior to ignition. In some of the larger boats, forced draft ventilation systems have been provided in their engine compartments and the recommended procedure is to actuate this ventilation system prior to starting the engine. The U.S. Coast Guard has developed recommended ventilation operating times for the ventilation systems of specific boats which takes into consideration the size of the engine compartment and the operating characteristics of the ventilation system. These recommended ventilation times can range anywhere from under a minute to two minutes or more. These ventilation procedures and times are typically detailed in the instruction manuals for the boat and are presented on a reminder tag which is mounted by the control console of the boat.

While the above procedures will tend to provide for the proper ventilation of an engine compartment prior to starting, there is still the opportunity for error. There are numerous situations where the operator will forget to follow the standard starting procedures or will consciously decide to dispense with the ventilating step. Likewise, the situation will frequently occur that the ventilation system is not operated for sufficient time to properly purge the engine compartment of combustible fumes. In each of these situations the potential for an accidental explosion exists even though the boat is equipped with a forced draft ventilation system and procedures exist which are designed to obviate this hazard. Accordingly, there is a definite need for control system which insures proper ventilation of an engine compartment prior to starting the engine. Likewise, there is a need for a control system for a ventilation system which is automatically actuated when the operator starts the engine.

SUMMARY OF THE INVENTION

Accordingly, it is an object of this invention to provide an improved control circuit.

Another object of this invention is to provide an improved engine starting system and control circuit.

Another object of this invention is to provide an improved starter control circuit which actuates a ventilation circuit before the engine start circuit is actuated.

Another object of this invention is to provide an improved starter control circuit which first requires that a first circuit be actuated for a specified period of time prior to the actuation of the starter circuit.

Another object of this invention is to provide a starter control circuit which will be actuated regardless of whether the ignition switch is moved to either the "START" position or to the "ON" position.

Another object of this invention is to provide an improved control circuit which actuates a ventilation circuit for an engine compartment for a preselected period prior to permitting the starting of the engine in the engine compartment.

Another object of this invention is to provide a starter control system which actuates a boat ventilation circuit for a specified period of time prior to actuation of the starter circuit.

In the broader aspects of this invention a control circuit is provided which has first and second circuits connected to a switch and a timer whereupon energizing the switch and timer first energizes the first circuit for a predetermined time, and thereafter energizes only the second circuit.

BRIEF DESCRIPTION OF THE DRAWINGS

Other objects, advantages and novel features of the present invention will become apparent in the following more detailed description of the invention when considered in conjunction with the following drawings wherein.

DESCRIPTION OF THE EMBODIMENT

Figure 1:
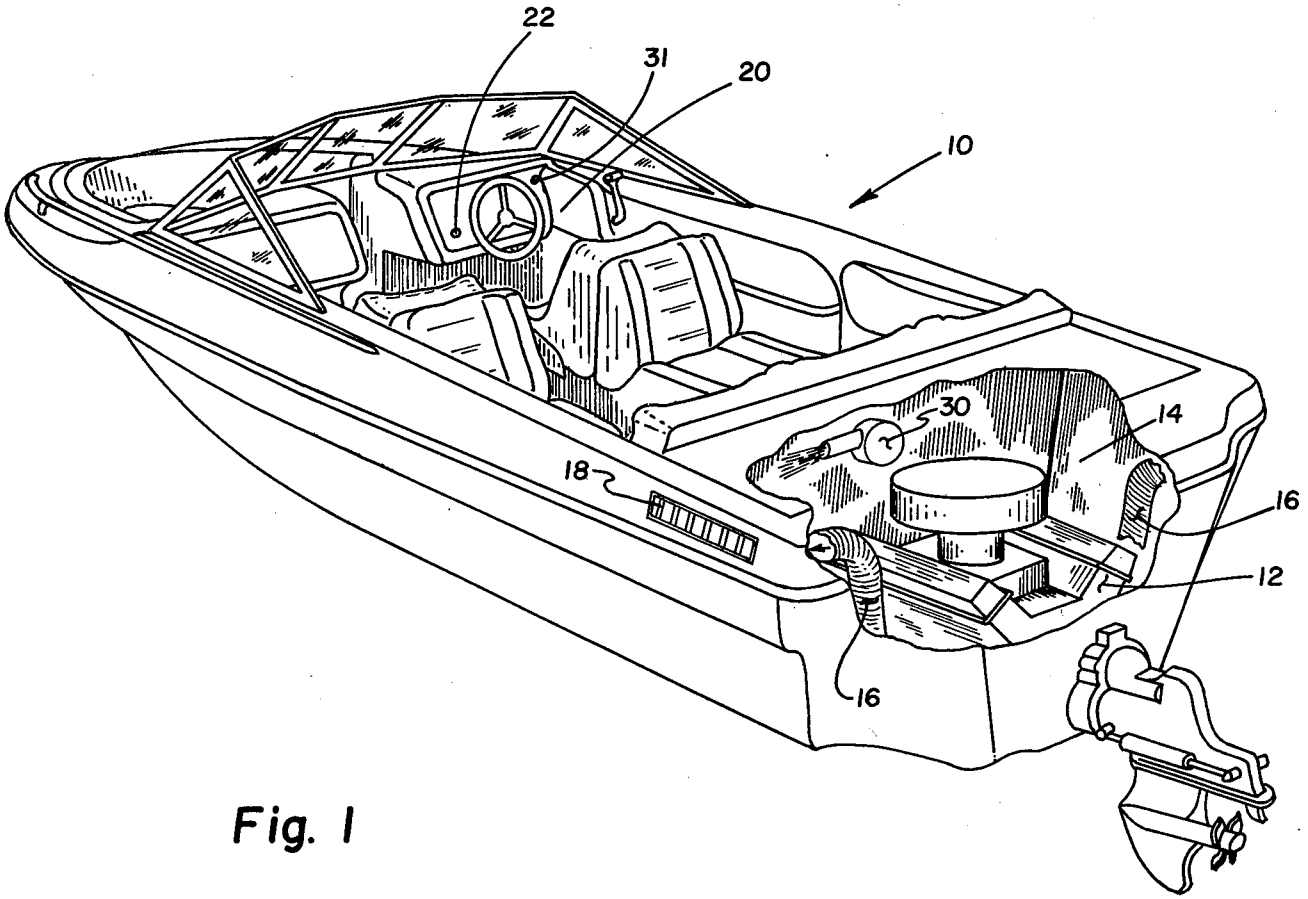
FIG. 1 is a perspective view of a boat having an inboard/outboard engine and having parts broken away to show the inside of the engine compartment.
Figure 2:
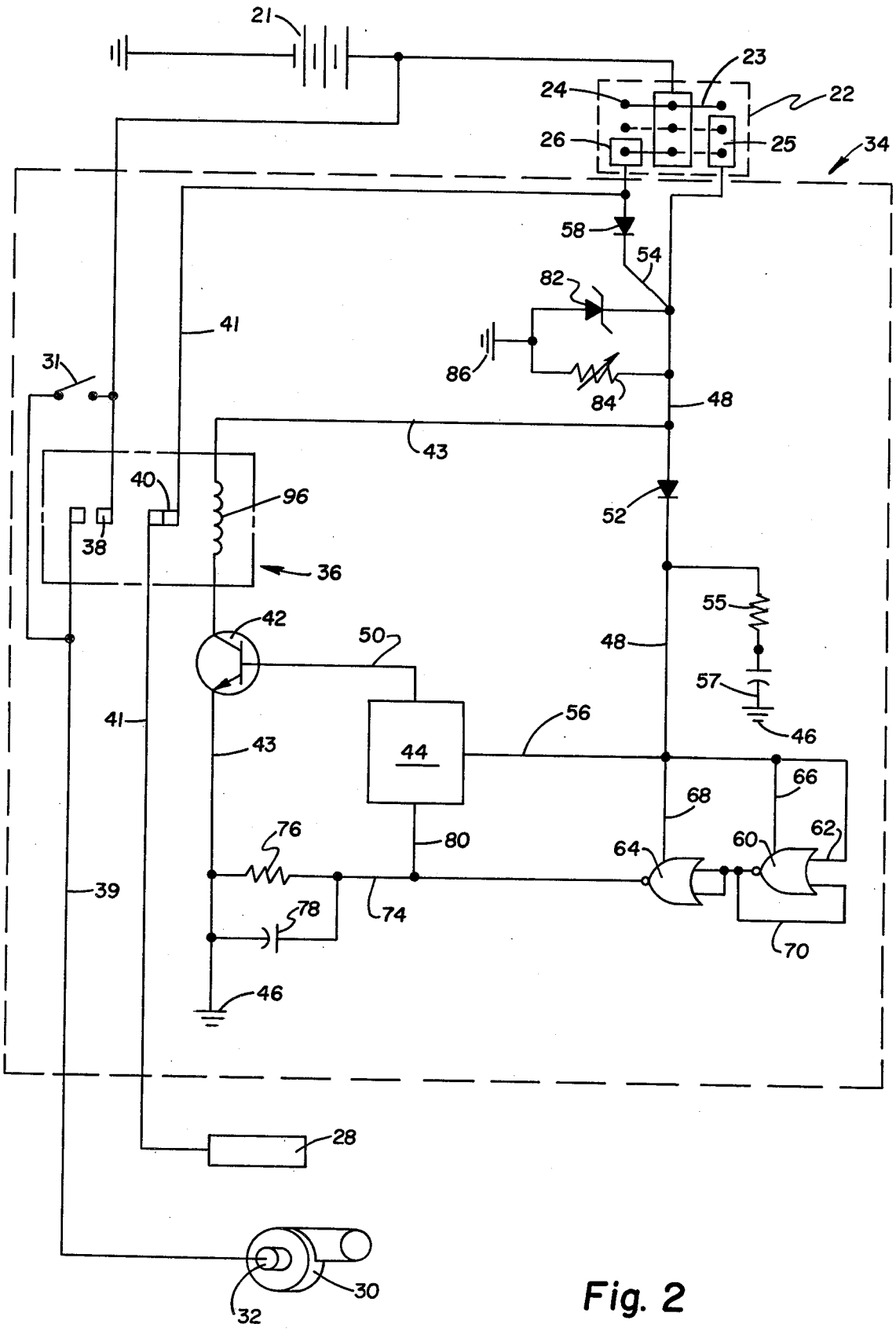
FIG. 2 is an electrical schematic diagram of the control circuit that is coupled to the ignition switch and controls the ventilation circuit and the starting circuit in the boat.

Referring to FIG. 1, a boat 10 is shown having an inboard/outboard engine 12 mounted in engine compartment 14. The engine compartment is generally formed with one or more vent conduits 16 which extend from the inside of compartment 14 to the outside vents 18 formed at the rear of the boat. The boat would typically be operated from the pilot area 20 which would include the steering wheel and the normal start-stop, speed, and electrical controls. The starting circuit for this type of boat would generally include a three position ignition switch 22 which as seen in FIG. 2, has a two arm contact 23 which cooperates with "OFF" position 24, "ON" terminal 25 and a "START" terminal 26. When the ignition switch is switched from "OFF" to "ON", the contact 23 connects battery 21 to "ON" terminal 25 and when it is switched to the "START" position, contact 23 couples battery 21 to both the "ON" terminal 25 and the "START" terminal 26. In this fashion, battery power will be supplied to the boat's electrical system regardless of whether the ignition switch is in the "ON" position or the "START" position or is being moved between the "ON" position and the "START" position.

The ignition switch 22 would typically be located at the dashboard of the controls and would be electrically coupled, as seen in FIG. 2, to a battery 21 and to the electric starter solenoid of the starter circuit 28. Thus, in boats not equipped with the control circuit described herein, the actuation of the ignition switch to the "START" position would actuate the starter solenoid in order to start the engine.

A forced draft ventilation system is also shown which would include one or more fans or blowers 30 which is operated by the boat's electrical system so as to vent the engine compartment of any combustible fumes. The blowers 30 are typically located in the engine compartment and are positioned so as to exhaust, or force, the air in engine compartment 14 out through vent conduits 16. A separate control switch 31 for such ventilation system would typically be located on the dashboard or control console and would manually control the operation of the blower 30.

As seen in FIG. 2, the control circuit 34 of the present invention would be coupled to ignition switch 22 and would control both the starter circuit 28 and the ventilation system. The control circuit 34 includes a two pole relay 36 having a first pole 38 which interrupts and controls line 39 to the blower 30 and a second pole 40 which interrupts and controls line 41 to the starter circuit 28. The control circuit 34 actuates the coil 96 of relay 36 so as to open the second pole 40 and close the first pole 38 for a preselected period of time and then the relay reverses so that the ventilation circuit shuts off and the starter circuit can be actuated. The control of the coil 96 is achieved by transistor 42 which acts as a switch means which, in turn, is controlled by one shot timer network 44 which serves as a timing means for controlling the length of time that coil 96 is actuated. The transistor 42 is electrically coupled in line 43 which extends from ground 46 through transistor 42 and coil 96 to one input line 48 that extends to the "ON" contact 25 of ignition switch 22. The base of transistor 42 is coupled via line 50 to the output of one shot timer network 44. The one shot timer is a conventional element which by use of external resistance and capacitance is designed to have an actuation time equal to the recommended ventilation time, or in other words, equal to the time that the ventilation system is to be operated prior to starting the engine. As will hereinafter be described, the one shot timer is actuated when the ignition switch is either switched to the "ON" position or to the "START" position and the control circuit is provided with suitable time delay circuitry and a transient suppressor network to permit proper operation in controlling the starting of an engine.

Current input to one shot timer network 44 is supplied from the battery 21 either through line 48, diode 52 and line 56 or through line 54, diode 58, line 48, diode 52 and line 56. Line 48 is grounded through resistor 55 and capacitor 57. Current will also be supplied through line 48 to one input of NOR gate 60 via line 62 and as control inputs to NOR gates 60 and 64 via lines 66 and 68, respectively. The output from NOR gate 60 is fed into NOR gate 64 and is also provided in a feedback loop 70 as the second input to NOR gate 60. The output of NOR gate 64 is fed via line 80 into the trigger node of one shot timer 44 and via line 74 into a resistor/-capacitor trigger network. The trigger network is made up of resistor 76 and capacitor 78 electrically coupled in parallel between line 43 and line 74.

The combination of the NOR gates 60 and 64 provide a time delay means which momentarily delays the input signal from lines 48 or 54 from reaching the trigger node of one shot timer 44. This delay means provides sufficient time for the control circuit to be completely energized before the trigger signal reaches the triggering node of the one shot timer.

Control circuit 34 also includes a transient suppressor network coupled at the input end of line 48 and 54 which comprises a zener diode 82 and metal oxide varistor 84 electrically coupled in parallel between line 48 and ground 86. The transient suppressor network serves to protect components in the control circuit 34 from high voltage and high current transient which might enter via line 48 and/or 54.

In operation, the ignition switch 22 would be turned to either the "ON" position 25 or directly past the "ON" position to the "START" position 26. In either case, as soon as arm 23 contacts pole 25, battery 21 energizes the control circuit 34. If, for example, the ignition is turned directly to "START", the arm 23 would remain in contact with pole 25 and when contact had been made with pole 26, line 41 is also added into the circuit, but interrupted by pole contacts 40.

Current entering via lines 48 or 54 pass through diodes 52 and 58, respectively, which serve to limit the current flow to one direction and thereby avoiding possible circuit damage due to a backward current surge. It will be recognized that line 54 and diode 58 are not required in the present circuit because the ignition (or "ON") circuit is not interrupted when the switch is moved to the "START" position and that element 54, 58 would be required with switches that break or interrupt the ignition circuit when the switch is moved from "ON" to the "START" position. The current then enters via line 56 to the power input port of one shot timer 44 and also passes through NOR gates 60 and 64 which are designed, in conjunction with the resistor/-capacitor trigger network (76, 78), to slow down and pulse the trigger signal applied to the timing node line 80 for one shot timer 44. More specifically, current enters NOR gate 60 as a positive (+1) signal and exits this element as a zero (0) signal. The signal then enters NOR gate 64 and exits as a positive (+1) signal again. The signal exiting NOR gate 64 initially charges capacitor 78 so as to cause the signal in line 80 to be pulled to absolute zero (0). As the capacitor slowly builds up a charge, restrained by resistor 76, the signal in line 80 changes from a zero (0) to a positive (+1). This change of being pulled to zero and raising to (+1) triggers the timing node of one shot timer 44.

When one shot timer 44 is actuated, the output on line 50 from one shot timer 44 goes positive (+1) for a preselected period of time and then goes to zero (0) and stays zero (0) until the entire circuit is reset by turning the ignition switch to the "OFF" position. The positive (+1) output on line 50 causes transistor 42 to switch on and thereby permitting electrical current to flow from line 48 through coil 96, through line 43 to ground 46. Thus, during this period of time that output line 50 is positive, coil 96 is actuated so as to close pole 38 and open pole 40 of double pole relay 36. When this occurs the battery current flow through line 39 to actuate the blowers 30 of the ventilation system.

When one shot timer 44 shuts off, line 50 returns to zero and thereby switching off transistor 42 which, in turn, turns off coil 96. At this point the two-pole relay 36 reverses so that pole 38 opens and pole 40 closes. Thus, when the ignition switch is turned to "START" the battery current is permitted to pass via line 41 and closed pole 40 to the starter solenoid of the starter circuit 28. It will be understood from the above-description that actuation of the ignition switch 22 to either the "ON" position or to the "START" position will actuate the ventilation circuit for a preselected period of time and thereafter permitting the actuation of the starting circuit. Accordingly, if the ignition switch is immediately turned from "OFF" to "START", the starter circuit will not be actuated until the ventilation circuit has been actuated for the required length of time. Alternatively, the operator can initially turn the ignition switch from "OFF" to "ON" and when he hears the ventilation system shuts off, he can then turn the switch to "START" and the starter circuit will then immediately be actuated.

If, during the operation of the boat, a high voltage or high current transient were to appear at the input end of line 48 and/or 54 the transient suppressor network would be actuated and varistor 84 would become conductive and permit the transients to flow to ground 86. The zenier diode 82 is used to latch the voltage within operating specifications of the circuit components.

In summary, a control circuit has been provided which actuates a ventilation circuit for a predetermined period of time prior to the actuation of the starting circuit. There are any number of alternative designs that can achieve this end result and still come within the scope of the claimed invention. For example, other transient suppressors such as regulators and capacitors could be employed in lieu of the transient network disclosed. Likewise, alternative signal delay means could be constructed employing other binary logic elements in place of NOR gates 60, 64 and other elements and circuit configurations could be employed in place of the resistor/capacitor network disclosed. Finally, additional elements such as switches and indicator lights could be coupled into the control circuit to provide, for example, for selectively coupling the control circuit to the starting circuit or to indicate when the ventilation circuit has operated for the required period of time and the starting circuit can be actuated. Accordingly, while the principles of this invention have been described above in connection with a specific circuit and related apparatus, it is to be clearly understood that this description is made only by way of example and not as a limitation to the scope of the invention.

What is claimed is:

1. A control circuit comprising:

a double pole relay, said relay having a first pole for controlling a first electrical circuit, a second pole for controlling a second electrical circuit, said relay having an actuating coil for actuating said relay;

switch means electrically coupled to said coil;

timing means electrically coupled to said switch means including a one shot timer network having a power input, power output, and triggering input, said power output being electrically coupled to said switch means, an electrical input line extending to said power input and said triggering input and adapted to receive an electrical input actuating signal;

a time delay means in said input line for delaying said electrical input signal to said triggering input of said one shot timer network;

said timing means controlling the actuation time of said switch means, said switch means controlling the actuation of said coil of said relay whereby upon actuation of said timing means said switch means is actuated for a preselected period of time during which said first pole is closed and said second pole is open and thereafter said second pole is closed and said first pole is open.

2. The control circuit defined in claim 1 wherein said time delay means includes binary logic elements connected in said input line between said triggering input of said one shot timer and the source of said electrical input signal.

3. The control circuit defined in claim 2 which further comprises a resistor/capacitor triggering network electrically coupled to the output from said binary logic elements and to said triggering input.

4. The control circuit defined in claim 1 in which further comprises a transient suppressor network electrically coupled to said input line.

5. The control circuit defined in claim 4 wherein said transient suppressor network includes a zener diode and a varistor electrically coupled in parallel between said input line and ground.

6. The control circuit defined in claim 1 wherein said switch means is a transistor having its base electrically coupled to said power output of said one shot timer network.

7. The control circuit defined in claim 1 wherein said one shot timer network is reset by being deenergized.

8. The control circuit defined in claim 1 wherein said first electrical circuit is a ventilation control circuit that controls the forced draft ventilation system in the engine compartment of a boat and the second electrical circuit is an engine starting circuit.

9. An engine starting system comprising:

an electrical engine starting circuit, an electrical ventilation circuit, a battery, control means coupled to said starting circuit and said ventilation circuit including timing means having power and triggering inputs with a delay circuit coupled to the triggering input, an ignition switch electrically coupled to said battery, said ignition switch also being electrically coupled to said starting circuit through said control means whereby when said ignition switch is actuated to initiate said starting circuit, power is applied to the timing means power input and thereafter by way of the delay circuit to the triggering input to actuate said ventilation circuit for a preselected period of time as determined by the timing means and then allows actuation of said starting circuit after said preselected period of time.

10. The engine starting system defined in claim 9 wherein said ignition switch is a three position switch having an "OFF" position, and "ON" terminal, and a "START" terminal, said control means being electrically coupled to both said "ON" terminal and said "START" terminal so that said control means will be operated regardless of whether said ignition switch is turned from said "OFF" position to either said "ON" terminal or to said "START" terminal.

11. The engine starting system defined in claim 10 wherein said control means is a control circuit comprising:

a double pole relay, said relay having a first pole for controlling a first electrical circuit, a second pole for controlling a second electrical circuit, and an actuating coil for actuating said relay;

switch means electrically coupled to said coil;

the timing means being electrically coupled to said switch means;

electrical input lines extending from said "ON" terminal and said "START" terminal to said timing means;

said timing means controlling the actuation time of said switch means, said switch means controlling the actuation of said coil of said relay whereby upon actuation of said timing means said switch means is actuated for a preselected period of time during which said first pole is closed and said second pole is open and thereafter said second pole is closed and said first pole is open.

12. The engine starting system defined in claim 11 wherein said ventilation circuit controls a forced draft system in an engine compartment of a boat, said timing means being selected to actuate said switch means for a predetermined period of time, said time period being selected to be the desired operating time of said forced draft ventilating system.

13. The engine starting circuit defined in claim 11 wherein said timing means is a one shot timer network having a power output electrically coupled to said switch means, said one shot timer network also having a power input and a triggering input electrically coupled to said electrical input lines.

14. The engine starting system defined in claim 13 wherein said one shot timer network is reset by turning said ignition switch to said "OFF" position.

15. The engine starting system defined in claim 13 wherein said delay circuit comprises time delay means for delaying any signal from said input lines to said triggering input of said one shot timer network.

16. The engine starting system defined in claim 15 wherein time delay means includes binary logic elements connected between said triggering input and said ignition switch.

17. The engine starting system defined in claim 16 wherein said control circuit further comprises a resistor/capacitor triggering network electrically coupled to the output of said binary logic elements and to said triggering input of said one shot timer network.

18. The engine starting system defined in claim 17 wherein a transient suppressor network is electrically coupled to said input line from said "ON" and "START" terminals.

19. The engine starting system defined in claim 18 wherein said transient suppressor network includes a zener diode and a varistor electrically coupled in parallel between said input line and ground.

20. An engine starting system comprising:

an electrical engine starting circuit;

an electrical ventilation circuit;

a battery;

control means coupled to said starting circuit and said ventilation circuit including first normally open switch means coupled between the battery and the electrical ventilation circuit and second normally closed switch means in the electrical engine starting circuit, said first and second switch means actuable in unison, the first to connect the ventilation circuit to the battery and the second to preclude actuation of the engine starting circuit; and an ignition switch electrically coupled to said battery, said ignition switch also being electrically coupled to said starting circuit through the second switch means of the control means whereby when said ignition switch is actuated to initiate said starting circuit, said control means actuates said ventilation circuit for a preselected period of time and then allows actuation of said starting circuit after said preselected period of time.

* * * * *

UNITED STATES PATENT AND TRADEMARK OFFICE

CERTIFICATE OF CORRECTION

PATENT NO. : 4,473,025

DATED : September 25, 1984

INVENTOR(S) : David H. Elliott

It is certified that error appears in the above-identified patent and that said Letters Patent is hereby corrected as shown below:

IN THE CLAIMS:

Claim 4, line 1, delete "in", second occurance.

Signed and Sealed this

*Fifth* Day of *March 1985*

[SEAL]

*Attest:*

DONALD J. QUIGG

*Attesting Officer* *Acting Commissioner of Patents and Trademarks*